US009050709B1

(12) United States Patent
Dovel

(10) Patent No.: US 9,050,709 B1
(45) Date of Patent: Jun. 9, 2015

(54) HAND-HELD SHARPENER WITH MULTI-STAGE SHARPENING CAPABILITIES

(75) Inventor: Daniel T. Dovel, Shady Cove, OR (US)

(73) Assignee: Darex, LLC, Ashland, OR (US)

( * ) Notice: Subject to any disclaimer, the term of this patent is extended or adjusted under 35 U.S.C. 154(b) by 706 days.

(21) Appl. No.: 13/315,101

(22) Filed: Dec. 8, 2011

Related U.S. Application Data

(60) Provisional application No. 61/420,953, filed on Dec. 8, 2010.

(51) Int. Cl.
*B24D 15/08* (2006.01)

(52) U.S. Cl.
CPC ..... *B24D 15/08* (2013.01)

(58) Field of Classification Search
USPC ..... 451/45, 344, 349, 461, 552, 555, 556, 451/557, 558; 76/82
See application file for complete search history.

(56) References Cited

U.S. PATENT DOCUMENTS

| | | | | | |
|---|---|---|---|---|---|
| 78,771 | A | | 6/1868 | Thayer | |
| 1,888,102 | A | | 2/1931 | Zahler | |
| 2,380,539 | A | * | 7/1945 | Miller | 451/557 |
| 2,652,667 | A | * | 9/1953 | Arnold | 451/555 |
| 3,719,461 | A | * | 3/1973 | Topping | 451/540 |
| 3,882,642 | A | | 5/1975 | Sykes | |
| 4,094,106 | A | | 6/1978 | Harris | |
| 4,197,677 | A | * | 4/1980 | Graves | 451/555 |
| 4,450,653 | A | * | 5/1984 | Fletcher | 451/552 |
| 4,558,540 | A | * | 12/1985 | Collins | 451/555 |
| D287,095 | S | * | 12/1986 | Hunter | D8/91 |
| 4,823,498 | A | * | 4/1989 | Banta | 43/25 |
| 5,046,385 | A | * | 9/1991 | Cozzini et al. | 76/89.2 |
| 5,163,251 | A | * | 11/1992 | Lee | 451/555 |
| 5,283,920 | A | * | 2/1994 | Plummer | 7/106 |
| 5,458,534 | A | * | 10/1995 | Campione et al. | 451/555 |
| 6,039,642 | A | * | 3/2000 | Collins | 451/557 |
| 6,048,262 | A | * | 4/2000 | Ray | 451/555 |
| 6,101,898 | A | * | 8/2000 | Gore et al. | 76/82 |
| 6,129,616 | A | * | 10/2000 | Klotz | 451/349 |
| D444,691 | S | | 7/2001 | Ray | |
| 6,371,841 | B1 | * | 4/2002 | Ray | 451/523 |
| 6,540,582 | B1 | * | 4/2003 | Primos et al. | 446/418 |
| 6,676,490 | B1 | * | 1/2004 | Kendhammer | 451/45 |
| D526,876 | S | * | 8/2006 | Smith | D8/93 |
| D560,461 | S | | 1/2008 | Epstein | |
| 7,467,991 | B2 | | 12/2008 | McCowen et al. | |
| 7,553,220 | B2 | * | 6/2009 | Smith | 451/451 |
| D604,134 | S | | 11/2009 | Smith et al. | |

(Continued)

*Primary Examiner* — Eileen P. Morgan
(74) *Attorney, Agent, or Firm* — Hall Estill Attorneys at Law

(57) ABSTRACT

A multi-stage hand-held sharpener includes a handle with an outer grip surface, and a first sharpening stage incorporated into the handle having a first abrasive surface. The first sharpening stage is adapted to facilitate a primary sharpening operation by a user upon a tool responsive to the user contactingly advancing a cutting edge of the tool against the first abrasive surface. A second sharpening stage includes a guide surface which extends in a non-orthogonal direction adjacent a second abrasive surface to establish a reference angle. The second sharpening stage facilitates a secondary sharpening operation by the user upon the tool responsive to the user contactingly engaging a side of the tool with the guide surface to orient the tool at said reference angle, and advancing a cutting edge of the tool against the second abrasive surface while maintaining the tool at said presentation angle.

20 Claims, 5 Drawing Sheets

(56) References Cited

U.S. PATENT DOCUMENTS

| | | | | |
|---|---|---|---|---|
| 8,221,199 | B2 * | 7/2012 | Smith | 451/552 |
| 8,267,749 | B2 * | 9/2012 | Smith et al. | 451/349 |
| 8,512,105 | B2 * | 8/2013 | Smith | 451/461 |
| 8,591,294 | B2 * | 11/2013 | Rieser | 451/461 |
| 8,721,399 | B1 * | 5/2014 | Huber et al. | 451/349 |
| 2006/0009141 | A1 * | 1/2006 | Smith | 451/540 |
| 2006/0194529 | A1 * | 8/2006 | Smith | 451/523 |
| 2008/0132159 | A1 * | 6/2008 | Smith | 451/557 |
| 2008/0171504 | A1 * | 7/2008 | Smith | 451/540 |
| 2009/0325473 | A1 * | 12/2009 | Smith et al. | 451/555 |
| 2012/0270481 | A1 * | 10/2012 | Smith | 451/461 |
| 2013/0065494 | A1 * | 3/2013 | Wu | 451/344 |

* cited by examiner

HAND-HELD SHARPENER WITH MULTI-STAGE SHARPENING CAPABILITIES

Related Applications

The present application makes a claim of domestic priority to U.S. Provisional Patent Application No. 61/420,953 filed Dec. 8, 2010, the contents of which are hereby incorporated by reference.

Background

Cutting tools such as knives are used in a variety of applications to cut or otherwise remove material from a workpiece. A cutting tool often has one or more laterally extending, straight or curvilinear cutting edges along which pressure is applied to make a cut. The cutting edge is often defined along the intersection of opposing surfaces that intersect along a line that lies along the cutting edge.

Cutting tools can become dull over time after extended use, and thus it can be desirable to subject a dulled cutting tool to a sharpening operation to restore the cutting edge to a greater level of sharpness. A variety of sharpening systems adapted to carry out a sharpening operation are known in the art, including, but not limited to, grinding wheels, whet stones, abrasive cloths, abrasive belts and sharpening steels.

Summary

Various embodiments of the present invention are generally directed to a multi-stage hand-held sharpener adapted to sharpen a cutting edge of a tool, such as a kitchen knife.

In accordance with some embodiments, a multi-stage hand-held sharpener generally comprises a handle with an outer grip surface. A first sharpening stage is incorporated into the handle. The first sharpening stage incorporates a first abrasive surface and is adapted to facilitate a primary sharpening operation by a user upon a tool responsive to the user contactingly advancing a cutting edge of the tool against the first abrasive surface.

A second sharpening stage includes a guide surface which extends in a non-orthogonal direction adjacent a second abrasive surface to establish a reference angle. The second sharpening stage facilitates a secondary sharpening operation by the user upon the tool responsive to the user contactingly engaging a side of the tool with the guide surface to orient the tool at said reference angle, and advancing a cutting edge of the tool against the second abrasive surface while maintaining the tool at said presentation angle.

These and other features and advantages that may characterize various embodiments can be understood with a review of the following detailed description section in conjunction with the associated drawings.

DETAILED DESCRIPTION

Figure 1A:
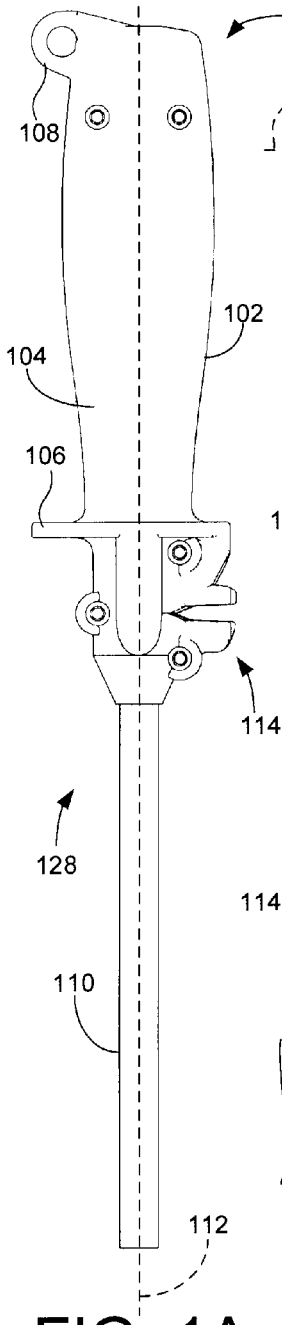
FIG. 1A provides a side elevational view of a two-stage hand-held sharpener in accordance with some embodiments.

Various embodiments are generally directed to a multi-stage hand-held sharpening system adapted to sharpen cutting tools, such as but not limited to kitchen knives and the like.

The sharpening system generally takes the overall form of a sharpening steel. As will be recognized by the art, a sharpening steel is a style of sharpener that facilitates a manual sharpening operation upon a cutting tool. Generally, a sharpening steel is a "dirk-like" member having an elongated abrasive member that extends from a user handle. The blade of the cutting tool, such as a knife, is sharpened by drawing the blade axially down along and laterally across the abrasive member. The term "steel" denotes the general style, rather than the material composition, of the sharpener.

As embodied herein, the sharpening system generally comprises a handle that incorporates a primary sharpening system, or stage, such as but not limited to a ripper, an electrically driven abrasive disc, a flat abrasive block, etc. The primary sharpening stage is adapted to provide a relatively coarse sharpening operation upon the tool.

A secondary sharpening stage of the sharpener provides a relatively fine sharpening operation upon the tool after use of the primary sharpening stage. The secondary sharpening stage includes an elongated abrasive member with an associated guide surface that establishes a presentation angle for the tool as the tool is advanced along the abrasive member.

For reference, the term "abrasive" will be understood broadly to describe a medium adapted to carry out one or more of the following sharpening operations upon a cutting tool to enhance its cutting effectiveness: smoothing, shaping, straightening, deforming, polishing, burnishing, filing, abrading or otherwise altering some physical characteristic of the tool, irrespective of whether or not material is removed from the cutting tool during the sharpening process.

The various exemplary abrasive rods disclosed herein can take any number of suitable forms, such as but not limited to steel, carbide, ceramic or diamond coated abrasive. The outer surface may be smooth or textured, and may be provided with regions with different types of surface features. A criss-crossing or otherwise ridged texture may be provided to the outer surface, or the surface may be smooth without any human observable gaps, ridges or undulations.

The abrasive media disclosed herein, which includes but is not limited to abrasive rods, may have any suitable shape including circular, rectangular, triangular, elliptical, segmented, disc-shaped, flat, etc. The abrasive media may be subjected to hardening, coating or other processing to enhance the sharpening characteristics. It is contemplated although not required that the abrasive media will have a hardness that is greater than a hardness of the cutting tool blade and that the abrasive media will exhibit little or no wear over time.

FIGS. 1A-2C show a hand-held sharpener 100 constructed and operated in accordance with some embodiments. The sharpener 100 includes a handle 102 with an outer surface 104 sized and shaped to be grasped by a hand of a user.

A pair of leg flanges 106, 108 extend from opposing proximal and distal ends of the handle 102. The leg flanges 106, 108 are dimensioned to contactingly engage a base surface (not separately shown) such as a countertop to allow the user to steady the sharpener 100 during use. The leg flanges 106, 108 may provide clearance for fingers of the user to wrap around an underside portion of the outer grip surface 104 of the handle 102. A through-hole aperture may be formed in the distal end leg flange 108 to facilitate hanging storage of the sharpener 100 when not in use.

An elongated member 110 extends from the handle 102 in a direction parallel to, and preferably centered about, a longitudinal axis 112 of the handle 102. The elongated member 110 is characterized as an abrasive rod, although such is not necessarily required as other forms of elongated abrasive members can be used. The axis 112 is shown to nominally pass orthogonally through the geometric center of the handle (and the rod), although it will be appreciated that this is merely illustrative and not limiting.

The abrasive rod 110 takes a generally cylindrical shape, although other elongated shapes can be used including tapered (frusto-conical) shapes. The rod 110 may be permanently affixed to the handle 102, or may be displaceable with respect to the handle.

Figure 1B:
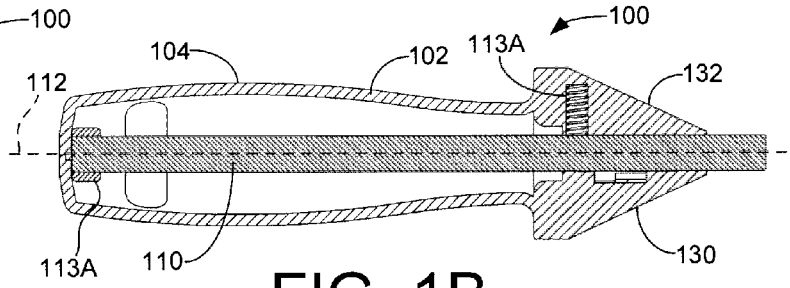
FIG. 1B is a side elevational cross-sectional view of the sharpener of FIG. 1A in a retracted orientation.

In some embodiments, the rod 110 can be partially or fully retracted along the longitudinal axis 112 so as to be nestingly received within an interior passageway of the handle to shorten the overall length of the sharpener 100, as represented in FIGS. 1B and 2. This allows the rod 110 to be extended when needed (FIG. 1A). Suitable internal locking mechanisms can be used to facilitate sliding movement of the rod 110, such as end cap 113A and bias spring 113B.

In other embodiments, the rod 110 may be removable from the handle 102 to facilitate detachment and reattachment as required. It will be appreciated that the attached rod provides a general "steel type" configuration for the sharpener 100, and a detached rod provides a "two piece" configuration for the sharpener.

Figure 2A:
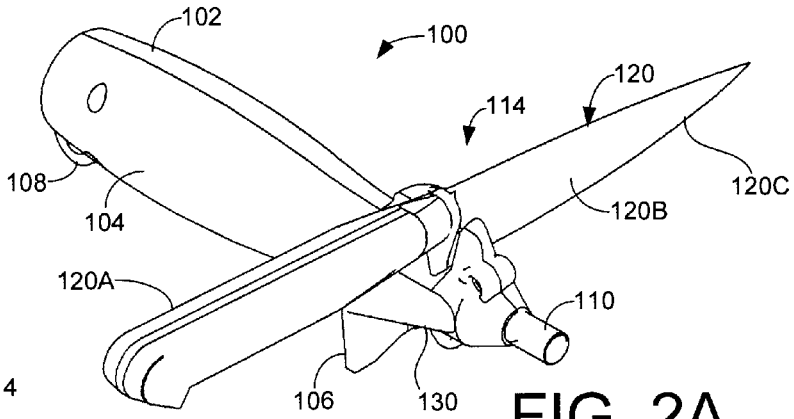
FIG. 2A is an isometric depiction of the sharpener of FIGS. 1A-1B in conjunction with a cutting tool being presented against a first sharpening stage of the sharpener.
Figure 2B:
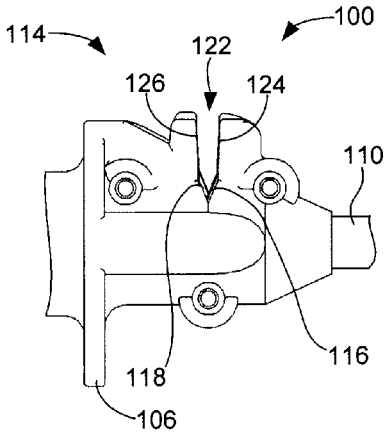
FIG. 2B is a close-up side elevational view of the first sharpening stage.
Figure 2C:
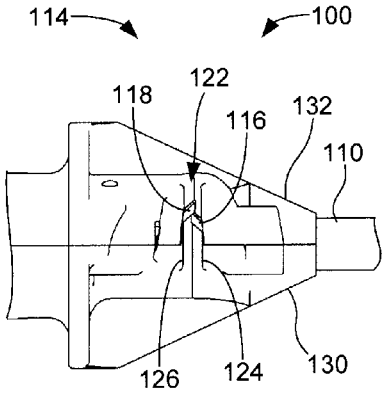
FIG. 2C is a close-up top plan view of the first sharpening stage.

A first sharpening stage is denoted at 114 and is characterized as a "pull-through ripper" type sharpener. As best shown in FIGS. 2A-2C, the first sharpening stage 114 comprises first and second crossed, hardened metal sharpening blades 116, 118. The sharpening blades 116, 118 form a v-shaped gap through which a cutting tool, such as kitchen knife 120 in FIG. 2A, can be drawn during a primary sharpening operation. The exemplary kitchen knife 120 is shown to include a knife handle 120A and a knife blade 120B. A cutting edge along the lower distal extent of the blade 120B is denoted at 120C.

FIG. 2B shows a blade guide channel 122 formed in the handle 102 of the sharpener 100 by opposing sidewalls 124, 126 which extend into the handle 102 in a direction toward the longitudinal axis 112. The blade guide channel 122 forms an aperture through which the sharpening blades 116, 118 extend and provides guide surfaces to contactingly engage one or both sides of the knife blade 120B to maintain the knife 120 at a desired presentation angle as the knife is drawn against the sharpening blades 116, 118.

The sharpening blades 116, 118 can be made of a suitably hard material, such as but not limited to tungsten carbide or a so-called super-abrasive (e.g., diamond, CBN, tungsten carbide, etc.) coated steel. Non-metallic blades may also be used. The blades 116, 118 may be spring biased to receive and act upon the knife 120. Depending on the initial condition of the knife 120, the first sharpening stage 114 may be capable of removing relatively large amounts of material from the knife along the vicinity of the cutting edge to provide a primary, or coarse, sharpening operation upon the knife.

A second sharpening stage 128 includes the abrasive rod 110, which is used in some embodiments to provide a secondary, or fine, sharpening operation upon the knife after the primary sharpening operation of the first sharpening stage. One or more blade guides, such as opposing blade guides 130, 132, may be incorporated into the second sharpening stage 128. The blade guides 130, 132 extend at a selected angle with respect to the longitudinal axis to assist the user in establishing a suitable presentation angle for the knife 120 against the rod 110. The blade guides are relatively long and narrow to allow clearance for the sharpening of the base portion of a blade next to the handle. It is contemplated that the secondary sharpening stage will tend to remove less material than the first stage from the knife (if any material is removed at all during the secondary operation).

Figure 3A:
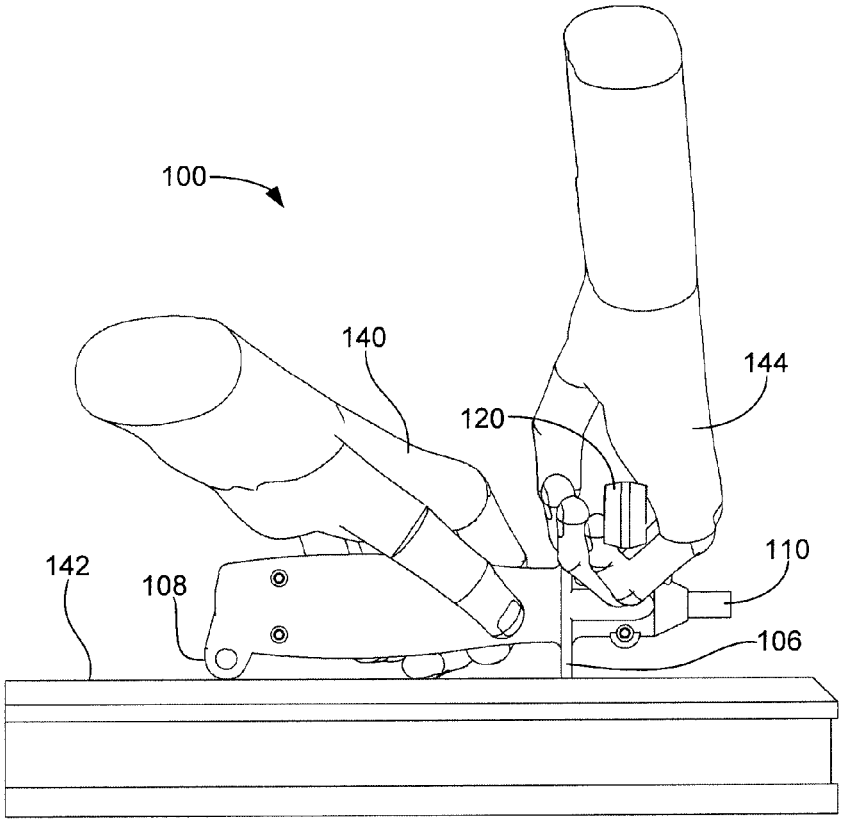
FIG. 3A generally illustrates an exemplary primary (coarse) sharpening operation in accordance with various embodiments.
Figure 3B:
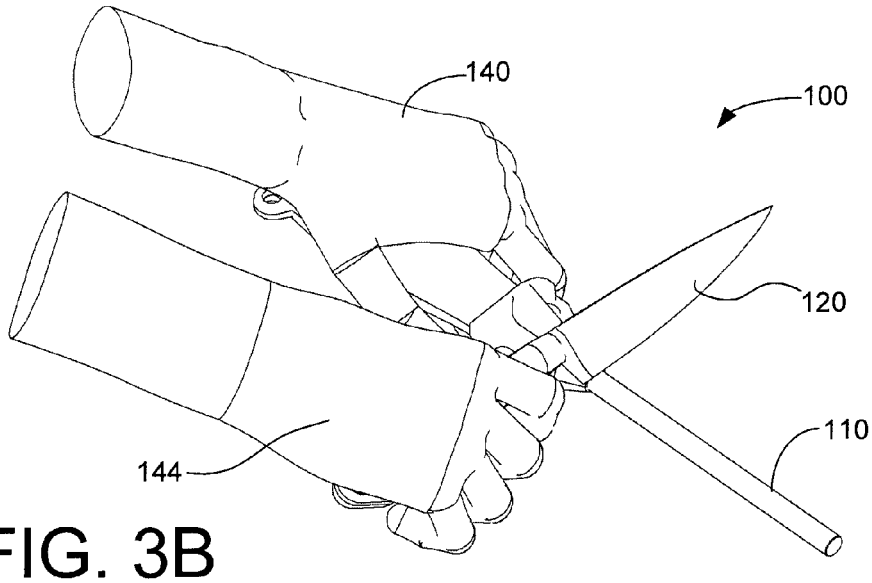
FIG. 3B generally illustrates an exemplary secondary (fine) sharpening operation in accordance with various embodiments.

FIGS. 3A-3B generally illustrate an exemplary sharpening sequence using the sharpener 100. To sharpen the knife 120, a user grasps the handle 102 of the sharpener 100 with a firsthand 140 (such as the left hand) and lowers the handle 102 onto a countertop 142 or other suitable work surface so that the leg flanges 106, 108 contactingly engage the countertop 142. The user may apply a small downwardly directed bias force to maintain the leg flanges 106, 108 in stationary contact with the countertop. This orientation is depicted in FIG. 3A.

The user next grasps the knife handle 120A with a second hand 144 (such as the right hand), and inserts the base of the knife blade 120B into the channel 122 of the primary sharpening stage 114. This will bring the base of the cutting edge 120C of the knife 120 into the v-shaped gap defined by the blades 116, 118. The user thereafter draws the knife 120 back through the channel 122 along the length of the blade 120B.

Depending on the curvature of the blade 120B, the user may need to induce some forward canting of the knife blade as the knife is drawn back to ensure the entirety of the longitudinal extent of the blade passes through the v-shaped gap and contactingly engages the blades 116, 118. Depending on the state of dullness and/or the extent of damage existing in the knife, the knife may be drawn through the first sharpening stage a number of successive times, such as 3-5 times or more.

Once the primary sharpening operation is completed, the user, while retaining the handle 102 in the left hand 140 and the knife handle 120A in the right hand 144, removes the knife 120 from the channel 122, and raises the sharpener 100 from the base surface so that the abrasive rod 110 is pointing away from the user's body.

The user next places the base of the blade 120B against the abrasive rod 110 while contactingly engaging a side of the blade against a selected one of the blade guides 130, 132, as depicted in FIG. 3B. While maintaining the knife blade at this angular orientation, the user advances the blade 120B along the rod 110 while laterally drawing the blade across the rod. This sequence may be repeated a suitable number of successive times, such as 3-5 times or more.

The user then repeats these steps using the remaining one of the blade guides 130, 132 so that both sides are honed against the abrasive rod. The user may wish to rotate the knife 120 in the right hand 144 so as to access the remaining blade guide 130, 132.

It will be noted that the primary sharpening operation may not be required every time the knife 120 is sharpened; rather, once the knife has been sharpened using both primary and secondary stages, the knife may be returned to its former sharpness after use by simply employing the second stage.

Figure 4:
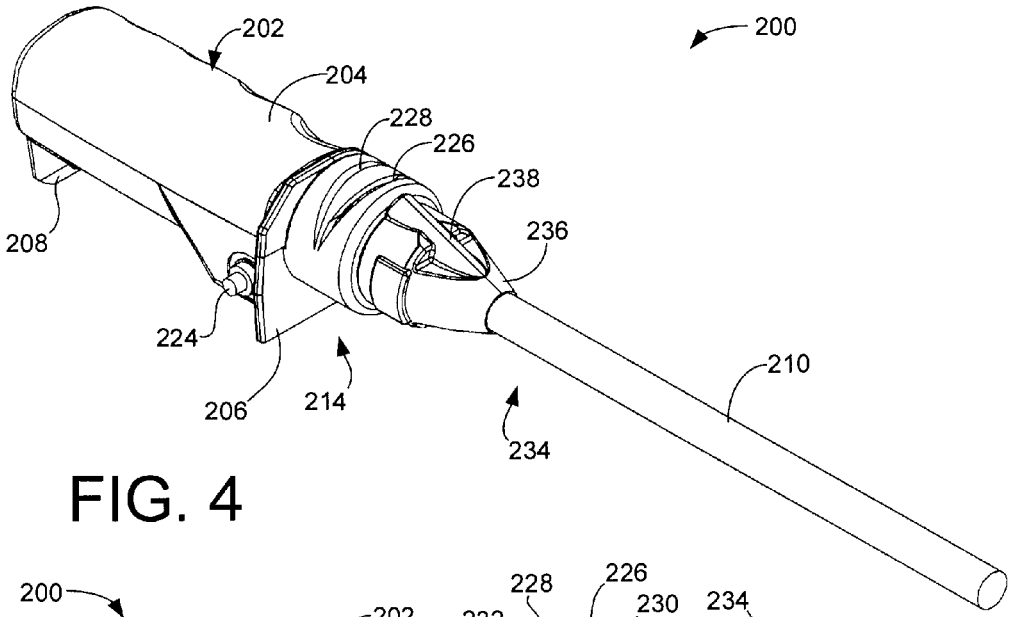
FIG. 4 is an isometric representation of a two-stage hand-held sharpener in accordance with further embodiments.
Figure 5A:
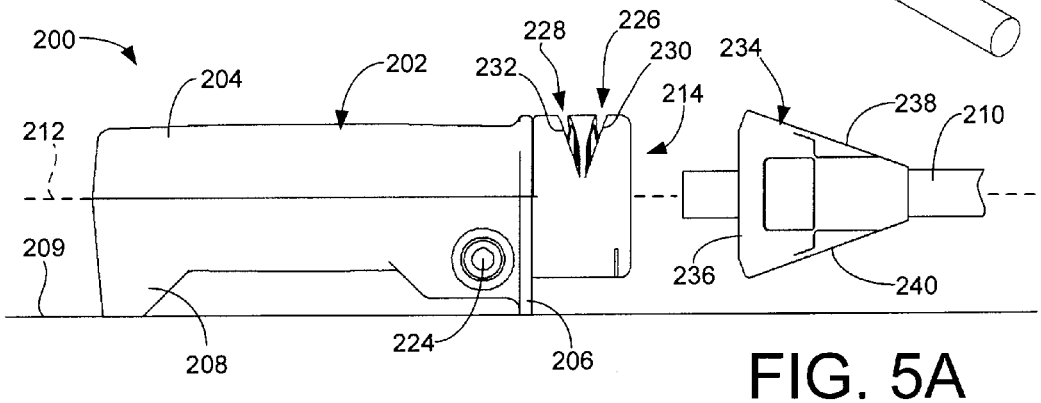
FIG. 5A is a side elevational representation of the sharpener of FIG. 4.
Figure 5B:
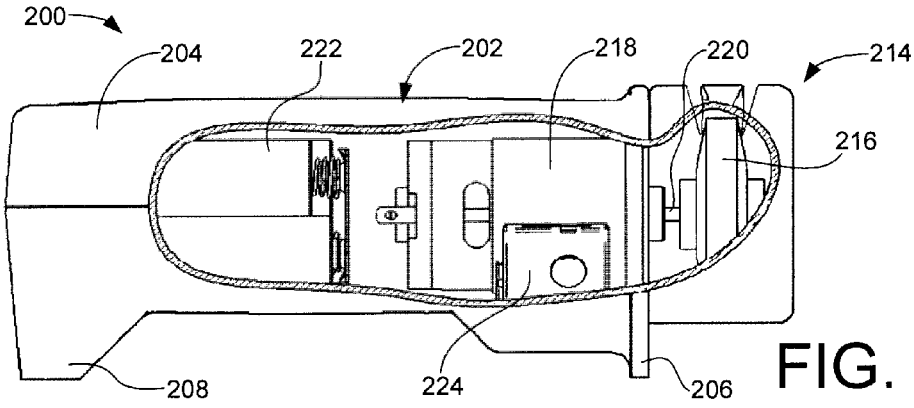
FIG. 5B provides a cross-sectional elevational view corresponding to FIG. 4.

FIGS. 4-5B generally illustrate another hand-held sharpener 200 constructed and operated in accordance with some embodiments. The sharpener 200 is generally similar to the sharpener 100 discussed above. One difference is that the sharpener 200 uses a motor-driven abrasive disc to provide primary sharpening operations upon a tool such as the knife 120.

The sharpener 200 includes a handle 202 with an outer grip surface 204 and opposing leg flanges 206, 208. As before, the leg flanges 206, 208 can provide clearance for the fingers of the user when the sharpener is placed on a base surface (denoted at 209 in FIG. 5A).

An elongated member 210 extends from the handle 202 parallel to a longitudinal axis 212 passing through the handle 202. As before, the elongated member 210 may be in the form of an abrasive rod, although such is not limiting. The rod 210 may be permanently affixed to the handle 202 or removable from the handle.

A first sharpening stage 214 is incorporated into the handle 202. As best shown in FIGS. 5A-5B, the first sharpening stage 214 includes an abrasive disc 216 which is rotated by an internal motor 218 via an interconnecting shaft 220. The motor 218 may be powered by an internal power supply 222 (e.g., battery pack), or may be powered by an external power source (e.g., transformed AC input voltage) through an electrical cord (not separately shown). Rechargeable batteries and a wireless recharging base station can be readily incorporated as desired. A user depressible, pressure sensitive switch 224 is mounted to the side of the handle 202. When depressed, the switch 224 initiates rotation of the disc 216.

Guide channels 226, 228 are formed by respective sidewalls 230, 232. The guide channels 226, 228 extend into the handle 202 to provide apertures that facilitate presentation of the knife blade 120B (FIG. 2) at suitable presentation angles against opposing sides of the rotating disc 216. The disc 216 is shown to have frusto-conical grinding surfaces, although other shapes and styles of discs can be used including flat discs, flexible discs, spring-loaded discs, etc.

A second sharpening stage 234 includes the abrasive rod 210 as well as a collar guide member 236. The collar guide member 236 supports a proximal end of the rod 210 and includes features that enable the member 236 to be removably affixed to the handle 202. The member 236 includes opposing blade guides 238, 240 to facilitate presentation of the tool against the rod 210 at a desired presentation angle.

As before, when the collar member 236 is affixed to the handle (e.g., FIG. 4), the sharpener 200 takes a general sharpening steel configuration. Two-stage sharpening can be carried out in a manner similar to that set forth above for the sharpener 100, using the motor driven disc 216 to effect the primary sharpening and the rod 210 and guides 238, 240 to effect secondary sharpening.

Figure 6:
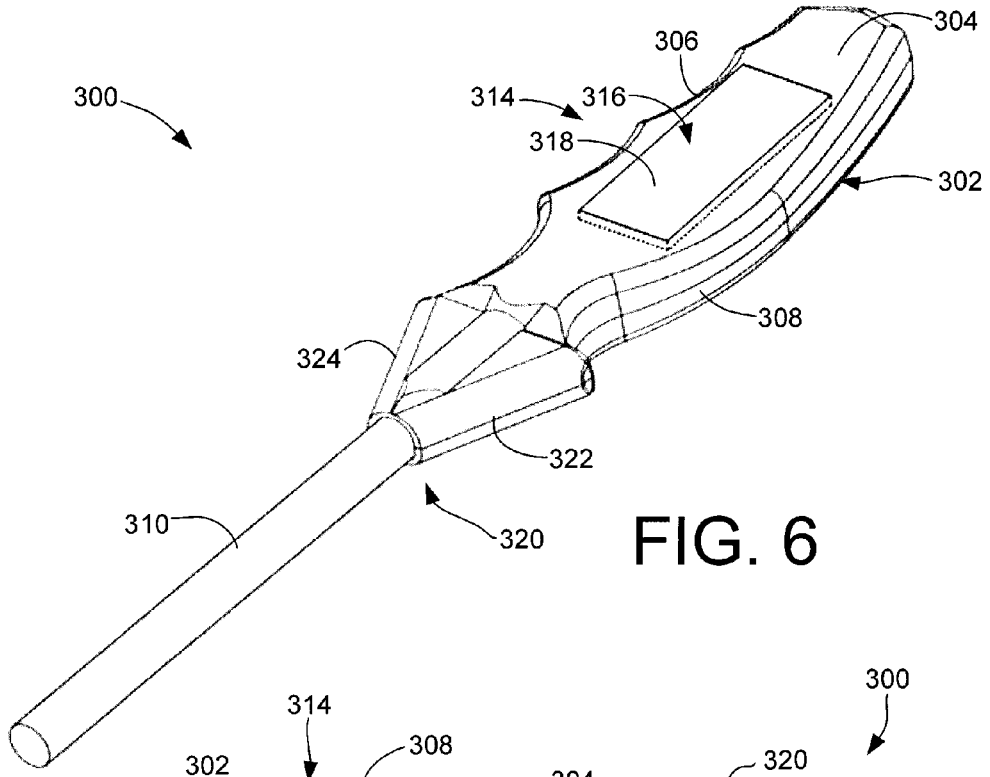
FIG. 6 presents an isometric representation of a two-stage hand-held sharpener in accordance with still further embodiments.
Figure 7A:
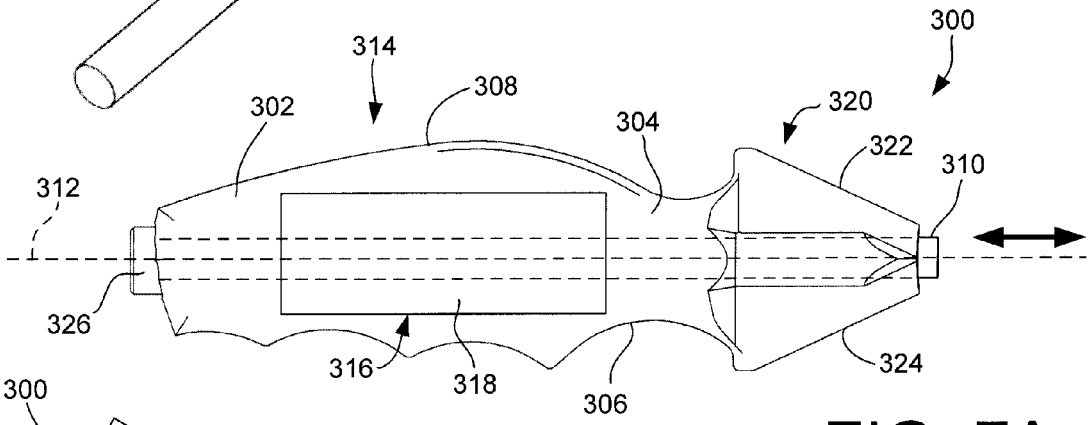
FIG. 7A is a side elevational view of the sharpener of FIG. 6.

FIGS. 6-7 illustrate another hand-held sharpener 300 constructed and operated in accordance with some embodiments. The sharpener 300 is generally similar to the sharpeners 100, 200 except that the sharpener 300 employs a planar grinding surface in the handle to provide primary sharpening operations.

The sharpener 300 includes a handle 302 with an outer grip surface 304 adapted to be gripped by the hand of a user. The grip surface 304 includes a scalloped lower surface portion 306 to accommodate the fingers of the user and a thumb-stop upper surface portion 308 accommodates a thumb of the user. As desired, the scalloped projections along portion 306 can be extended to operate as base support surfaces as with the leg flanges discussed above. An abrasive rod 310 (or other elongated member) is arranged to extend from the handle 302 parallel to a longitudinal axis 312 of the handle 302 as before.

A first sharpening stage 314 comprises an abrasive block 316 affixed to a side of the handle 304. The abrasive block is shown to be substantially rectilinear in shape, although other suitable shapes can be used including shapes that follow the contour of the handle outline. The abrasive block is recessed into and extends through the handle 302 to provide a planar abrasive surface 318 for coarse sharpening operations.

A second sharpening stage 320 includes the abrasive rod 310 as well as opposing blade guide surfaces 322, 324 which are incorporated into the handle 302. As before, the blade guide surfaces 322, 324 are provide on opposing sides of the abrasive rod 310 adjacent a proximal end thereof to facilitate presentation of the tool against the abrasive rod 310 at a selected presentation angle.

It is contemplated that the rod 310 is retractable into an interior channel of the handle 302 as depicted in FIG. 7. In some embodiments, an elastomeric button 326 may be affixed to the proximal end of the rod 310. Engagement features incorporated into the handle (not separately shown) may cooperate with the elastomeric button 326 to allow a user to transition the rod between an extended position (FIG. 6) and a retracted position (FIG. 7). In this configuration, depression of the button 326 by the user serves to advance the rod 310 a short portion of the way toward the extended position, and the user can grasp the distal end of the rod and slide the rod to the fully extended position.

As before, two-stage sharpening can be carried out in a manner similar to that discussed above for the sharpener 100. Primary sharpening can be carried out by holding or fixturing the handle 302 against a base surface and manually presenting the cutting edge of the blade against the abrasive surface 318. Secondary sharpening can be carried out using the abrasive rod and guides as before. It will be noted that the abrasive block 316 can advantageously be used for blade reshaping efforts to repair a damaged blade. It will be further noted that abrasive blocks such as 316 can be readily incorporated into the sharpeners 100, 200 to provide additional sharpening capabilities.

Figure 7B:
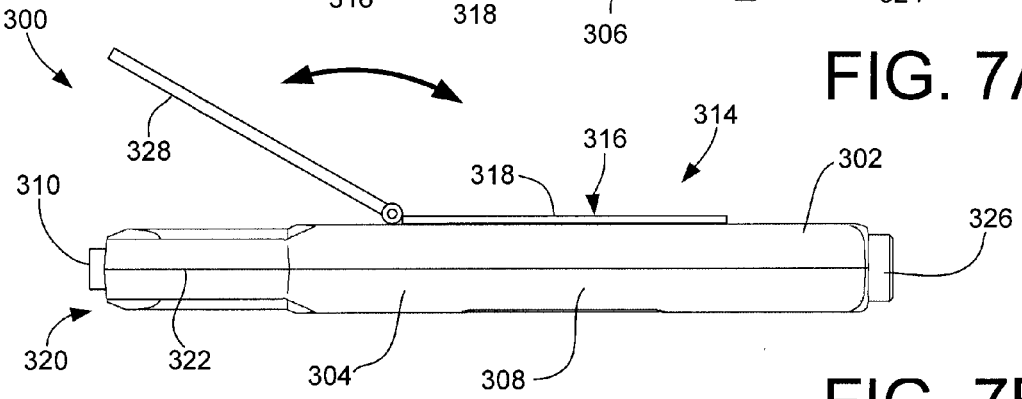
FIG. 7B is a top elevational view of the sharpener of FIG. 6.

As desired, a flip-top cover 328 can be incorporated into the handle 302, as generally depicted in FIG. 7B. The cover 328 can be used to cover the abrasive block 316 when not in use. The cover 328 can be hinged and configured to extend at a suitable guide angle to facilitate the imparting of a suitable presentation of the cutting tool against the abrasive surface 318 when the abrasive block 316 is in use. As desired, the block 316 may be affixed to the cover so that the block flips out and the body of the handle 302 may be used as a guide surface at the desired angle.

FIGS. 8A-8D illustrate various features associated with the foregoing embodiments. Another exemplary knife that can be readily sharpened by the sharpeners 100, 200, 300 is shown at 800 in FIG. 8A. The knife 800 includes a user handle 802 and a blade 804. The knife 800 can be sharpened by each of the various embodiments disclosed herein against an abrasive rod 806 by concurrently advancing the knife in an axial direction 808 while drawing the knife laterally across the rod 806 in a lateral direction 810. In this way, the entire length of the blade contactingly engages the rod. The user maintains the knife at the same reference orientation established by associated rod guide surface (not shown).

The blade 804 may be formed of any suitable material such as high carbon content stainless steel. While the knife 800 is a single bladed knife that tapers to a single cutting edge 812 (as shown in FIG. 8B), it will be noted that double bladed knives, as well as other types of cutting tools, can be readily sharpened by these systems by sharpening each cutting edge at a time.

Figure 8A:
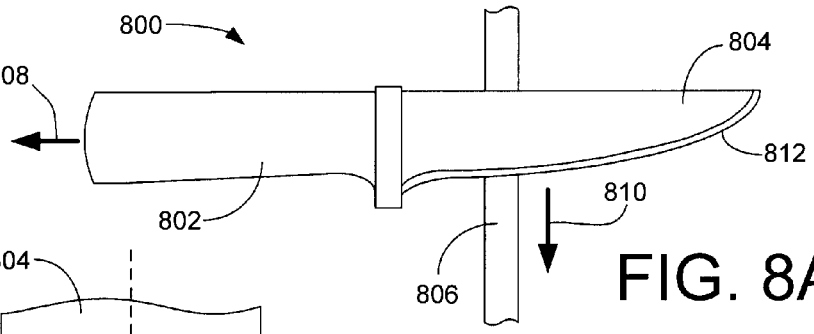
FIG. 8A depicts a cutting tool being presented for sharpening against an abrasive rod generally similar to the second stage abrasive rods of FIGS. 1-7.
Figure 8B:
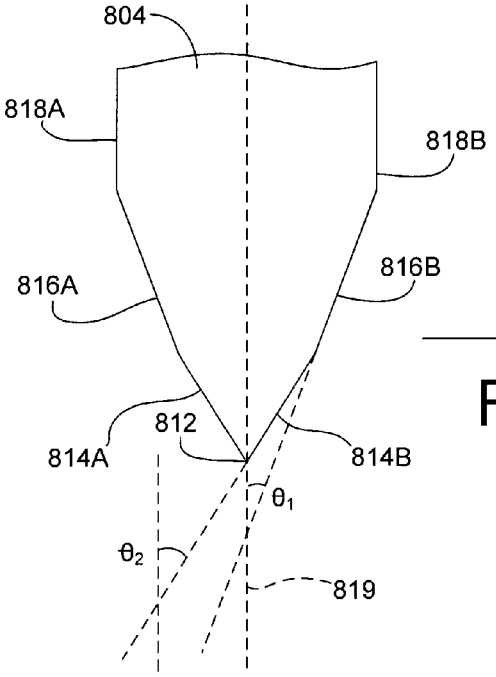
FIG. 8B is a cross-sectional elevational view of a distal cutting edge of the cutting tool of FIG. 8A.

The blade 804 in FIG. 8B is shown to have a micro-beveled configuration with respective beveled side surfaces 814A and 814B, beveled side surfaces 816A and 816B, and opposing parallel side surfaces 818A and 818B. The beveled surfaces 816A-B taper at a first sharpening angle $\theta_1$, and the beveled surfaces 814A-B taper to a second, greater sharpening angle $\theta_2$. These angles are relative to a centerline 819 that passes through the center of the blade 804 and through the cutting edge 812 as shown.

Suitable values for these sharpening angles of the knife 800 may be on the order of around 20 degrees for the first angle $\theta_1$ and 25 degrees for the second angle $\theta_2$, although other angles can be used. The shallower angle $\theta_1$ enhances cutting strength and sharpness, and the deeper angle $\theta_2$ improves durability of the cutting edge 812. The respective axial lengths of the angled surfaces can vary as required so that the various aspect ratios and dimensions are merely representative and not limiting.

Figure 8C:
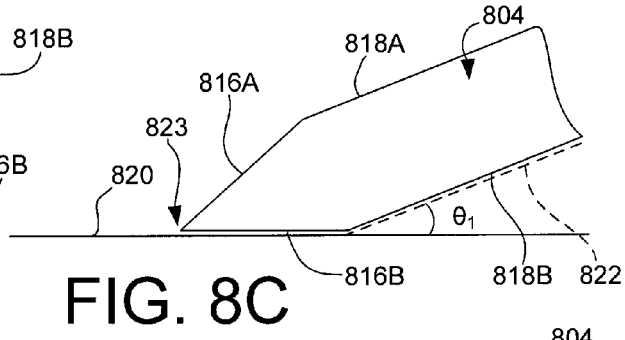
FIG. 8C depicts presentation of the cutting tool against a first-stage sharpener surface as depicted in FIGS. 1-7.

FIG. 8C generally represents a first stage sharpening operation in accordance with the foregoing embodiments. In FIG. 8C, the knife 800 is presented by the user against an abrasive surface 820 to establish the first angle $\theta_1$. It is contemplated that the first abrasive surface 820 may correspond to a selected one of the crossed blades 116, 118 of the pull-through ripper of FIGS. 1-3, a selected side of the rotatable disc 216 of FIGS. 4-5, the abrasive block 316 of FIGS. 6-7, or some other abrasive surface (including but not limited to an abrasive rod).

Generally, the knife may be presented at the first angle $\theta_1$ by a first guide surface 822 (denoted by dashed lines). This first guide surface may be provided, for example, by the sidewalls 124, 126 of the channel 122 and/or the respective blades 116, 118 in FIGS. 2A-2C, the opposing the sidewalls 230, 232 of the guide channels 226, 228 in FIG. 5A, the cover member 328 in FIG. 7B, or some other surface.

The contacting engagement of the knife against the first abrasive surface 820 will generally operate to remove relatively large amounts of material from the edge of the blade 804. Depending on the amount of material removed, the previously existing cutting edge and side surfaces may disappear and new ones formed. During this primary (coarse) sharpening, the beveled surfaces 816A and 816B will be formed and may extend to the end of the blade material and meet to form a first cutting edge 823.

Figure 8D:
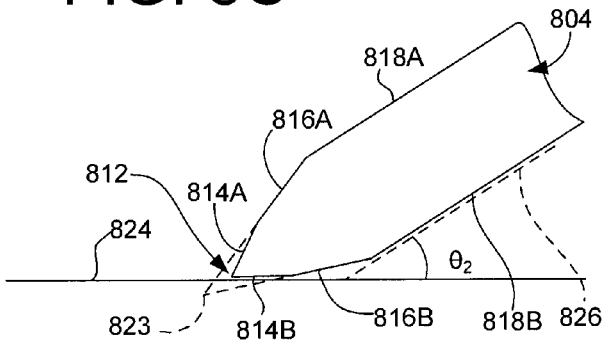
FIG. 8D depicts presentation of the cutting tool against a second-stage sharpener surface as depicted in FIGS. 1-7.

FIG. 8D generally represents a second stage sharpening operation in accordance with the foregoing embodiments. In FIG. 8D, the blade 804 is subsequently presented by the user against a second abrasive surface 824 to establish the second angle $\theta_2$. A suitable guide surface 826 can be used to set this angle. The second abrasive surface 824 in FIG. 8D can correspond to the outer abrasive surfaces of the abrasive rods 110, 210 and 310 in FIGS. 1-7, and the guide surface 826 can correspond to the respective abrasive rod guides 130, 132, 238, 240, 322 or 324. Other configurations can be used, however. For example, one or more reference guide surfaces can be disposed in other locations, such as but not limited to a position adjacent the distal end of the abrasive rod opposite the handle.

The second stage sharpening operation depicted in FIG. 8D generally operates to remove material from the distal end of the tip of the blade 804, thereby forming the side surfaces 814A-B and the cutting edge 812.

It will be appreciated that, given sufficient time and repetitive sharpening strokes, a dull blade could be honed to form the side surfaces 814A-B and cutting edge 812. However, it has been found that, in the case of a particularly dull, damaged or worn knife, that portion of the knife proximate the cutting edge may not contactingly touch the abrasive, so that the sharpening operation serves as a side-honing operation without affecting the characteristics of the cutting edge.

The various embodiments discussed above have used cylindrically shaped rods as the respective elongated members in the secondary sharpening stages. Other shapes and forms of elongated members can be used. For example, FIG. 9 shows a number of alternative cross-sectional shapes of elongated members that can be readily incorporated into the foregoing embodiments.

Figure 9:
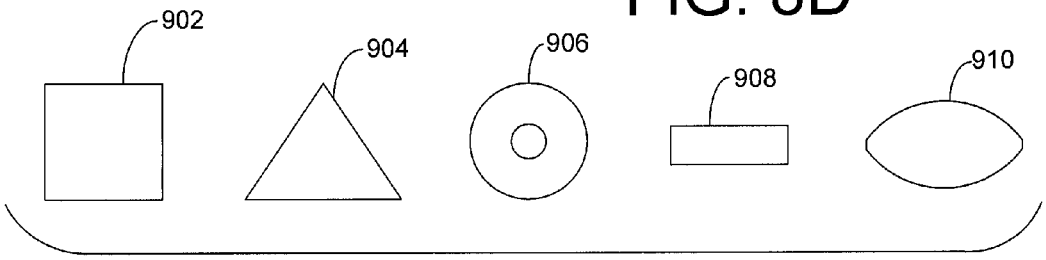
FIG. 9 shows alternative cross-sectional shapes for the elongated member of the embodiments of FIGS. 1-7.

The views in FIG. 9 correspond to an end view (looking toward the distal end of the respective members). These alternatives include a square shaped member 902, a triangularly shaped member 904, a frusto-conical (tapered) member 906, a rectilinearly shaped member 908 and a curvilinearly shaped member 910. Other shapes and forms can be used, including hollow members. While it has been contemplated that the abrasive surface of the second sharpening stage will extend fully around the outer surface of the elongated member, such is not necessarily required. It will be appreciated that associated rod guide surfaces can be disposed at various angular orientations corresponding to the various surfaces in FIG. 9.

Accordingly, a multi-stage hand sharpener as disclosed herein can be beneficial in sharpening the blade of a cutting tool. It has been found that sharpeners configured as described herein can quickly and easily impart razor or "scary" sharpness levels to a wide variety of different types and constructions of knives.

At least some of the various embodiments disclosed herein allow the use of a replaceable and/or retractable rod (or other elongated member). This can provide a number of benefits, including the ability to use different forms, types and/or shapes of rods, including ceramic rods and diamond coated rods, tapered rods, rods of different lengths, rods with different grits, and so on. Also, as very hard ceramic can be brittle, the ability to retract or remove a ceramic rod can reduce the possibility of damage due to the sharpening system being inadvertently dropped or otherwise subjected to a shock event.

The ability to retract a rod also can be a space-saving feature, which can be useful in both a kitchen setting where space may be at a premium, as well as in a portable setting where the sharpening system is taken on a camping trip or other outing. While it is contemplated that rods are relatively hard and durable, it is contemplated that from time to time such rods may become damaged or worn, necessitating replacement which can be easily effected.

It will be noted that in at least some of the various exemplary embodiments discussed above the second sharpening angle imparted to the blade by the second sharpening stage (e.g., 128, 234, 320) will be nominally the same as the first sharpening angle imparted to the blade by the first sharpening stage (e.g., 114, 214, 314). For example, the pull-through ripper stage 114 of FIG. 1 can be configured to nominally remove material at a selected angle (e.g., 25 degrees) and the respective guides 130, 132 can also be set at this same selected angle (e.g., 25 degrees).

In such case, the knife or other tool is drawn through the ripper to nominally set the opposing sides of the cutting edge at the desired angle during the primary sharpening operation, and then the secondary sharpening operation along the abrasive rod performs fine honing of the cutting edge at this angle. This would generally result in a knife having the configuration in FIG. 8C with side surfaces 816A-816B tapering to cutting edge 823.

Alternatively, the primary and secondary stages can be configured to impart different sharpening angles to the knife 800 to provide micro-beveling (different angled tapers on the same side or opposing sides of the cutting edge). For example, the ripper stage 114 of FIG. 1 can be set to impart a relatively lower angle (e.g., 20 degrees) and the respective guides 130, 132 can be set at a relatively higher sharpening angle (e.g., 25 degrees), providing a micro-beveled blade as in FIGS. 8B, 8D.

Another benefit of the various embodiments disclosed herein is the ability to incorporate the guide surfaces adjacent the handle at the base (proximal end) of the rod (or other elongated member). This can enhance safety since the guides can serve as a hand guard, thereby protecting the hand of the user that grasps the handle. Moreover, the orientation of the sharpener is such that the blade of the tool is pointed and moved away from the hand and the body of the user during secondary sharpening against the rod.

While not limiting, it is contemplated that it may be beneficial to set the secondary guide angle to be equal to or greater than the primary guide angle associated with a previous sharpening operation to provide a so-called micro-bevel configuration to the finally sharpened tool, such as illustrated in FIG. 8B. This sequencing allows for some user error when honing on the sharpening rod with regard to presentation angle, force, contact uniformity, etc.

This sequencing also may facilitate an efficient subsequent re-sharpening with minimal (or no) material removal by use of the secondary abrasive. It will be appreciated that while such sequencing is preferred, such is not necessarily required. For example, it is readily contemplated that a sharpening sequence may take place at the greater angle followed by the lesser angle. This may operate to remove material and thin the blade, which may be desirable in some circumstances.

Various additional alternatives and configurations will readily occur to the skilled artisan upon a review of the present disclosure, and all such alternatives and configurations are encompassed by the present application. While the various embodiments disclosed herein have been generally directed to a sharpener suitable for sharpening a knife, it will be appreciated that other types of cutting tools can be readily sharpened as desired.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed.

What is claimed is:

1. A hand-held sharpener for sharpening a cutting tool having a blade portion with opposing first and second side surfaces and a cutting edge therebetween, the hand-held sharpener comprising:

a handle having a longitudinal axis and an outer grip surface which surrounds said longitudinal axis;

a first sharpening stage incorporated into the handle and comprising a first abrasive surface, the first sharpening stage adapted to facilitate a primary sharpening operation by a user upon the tool responsive to the user contactingly advancing the cutting edge of the tool against the first abrasive surface to define a first beveled portion of the first side surface that nominally extends at a first angle with respect to a centerline passing through a center of the blade portion and the cutting edge; and a second sharpening stage comprising an elongated member which extends from the handle in a direction parallel to the longitudinal axis and a guide surface having a line contact portion that linearly extends in a non-orthogonal direction with respect to a second abrasive surface on the elongated member at a second angle, the second sharpening stage adapted to facilitate a secondary sharpening operation by the user upon the tool responsive to the user contactingly engaging the first side surface of the tool with the line contact portion of the guide surface to orient the tool at said second angle, and advancing the cutting edge of the tool against the second abrasive surface while maintaining the tool at the second angle to define a second beveled portion of the first side surface between the first beveled portion and the cutting edge that nominally extends at the second angle with respect to the centerline, the second angle greater than the first angle.

2. The hand-held sharpener of claim 1, the first sharpening stage further comprising a first stage guide surface adjacent the first abrasive surface adapted to contactingly engage a selected one of the first or second side surfaces of the tool to impart the first angle to the tool as the tool is advanced relative to and in contacting engagement with the first abrasive surface during the primary sharpening operation.

3. The hand-held sharpener of claim 1, wherein the guide surface of the second sharpening stage is characterized as a flat planar surface aligned along the line contact portion thereof.

4. The hand-held sharpener of claim 1, the guide surface of the second sharpening stage is characterized as a curvilinearly extending surface that curves away from the line contact portion thereof in a direction orthogonal to the longitudinal axis of the handle.

5. The hand-held sharpener of claim 1, in which the first sharpening stage is aligned along a top surface of the handle, and the guide surface of the second sharpening stage is aligned along a side surface of the handle.

6. The hand-held sharpener of claim 1, in which the first angle with respect to the centerline is nominally five degrees less than the second angle with respect to the centerline.

7. The hand-held sharpener of claim 1, in which the elongated member is removably affixed to the handle so that the elongated member is adapted to be integrated with the handle in a sharpening steel configuration and separated from the handle to provide two separate pieces in a multi-piece configuration, the handle adapted to repetitively support transitioning between said configurations.

8. The hand-held sharpener of claim 1, in which the elongated member is slideable in a direction parallel to the longitudinal axis between a retracted position in which the elongated member is nestingly received into an interior chamber of the handle, and an extended position in which the elongated member extends from the handle, the elongated member further being rotatable with respect to the housing in at least the extended position.

9. The hand-held sharpener of claim 1, further comprising first and second leg flanges which respectively extend from the handle adjacent opposing proximal and distal ends thereof, the leg flanges adapted to contactingly engage a base surface while the user grips the outer surface of the handle and biases the handle against said base surface, the leg flanges extending a sufficient length from the handle to form a gap adapted to accommodate the fingers of the first hand of the user between the outer surface and the base surface.

10. The hand-held sharpener of claim 1, in which the first sharpening stage comprises first and second crossed blades which form a v-shaped gap in a channel formed in the handle through which the cutting edge of the cutting tool is drawn by the user during said primary sharpening operation so that the first and second crossed blades respectively contact the opposing first and second side surfaces of the cutting tool adjacent the cutting edge.

11. The hand-held sharpener of claim 1, in which the first sharpening stage comprises an abrasive disc rotated by a motor disposed within the handle, the abrasive disc accessed during said primary sharpening operation by passing the cutting edge of the cutting tool through a guide channel in the handle and into contacting engagement with the abrasive disc, the guide channel comprising a first sharpening stage guide surface extending at the first angle.

12. The hand held sharpener of claim 1, in which the first sharpening stage comprises an abrasive block affixed to a selected side of the handle, the abrasive block projecting from the handle to present a nominally planar surface against which the cutting tool can be advanced to sharpen the cutting edge during said primary sharpening operation, the first sharpening stage further comprising a first sharpening stage guide surface which extends at the first angle.

13. A hand-held knife-sharpener for sharpening a cutting tool having a blade portion with opposing first and second sides and a cutting edge therebetween, the hand-held sharpener comprising:

a handle adapted to be gripped by a hand of a user;

a primary sharpening stage incorporated into the handle comprising a first abrasive surface and an adjacent first guide surface, the first guide surface contactingly supporting a selected one of the first or second sides of the blade portion of the tool, the cutting edge sharpened responsive to contact between the cutting edge and the first abrasive surface during a coarse sharpening operation as the selected one of the first or second sides of the blade portion is held against the first guide surface, the first guide surface extending at a first angle with respect to a centerline that passes through the blade portion and cutting edge of the tool; and a secondary sharpening stage comprising an elongated member supporting a second abrasive surface which extends from the handle in a first direction and a second guide surface having a line contact portion which extends from the handle toward the second abrasive surface in a second direction non-orthogonal to the first direction, the line contact portion of the second guide surface establishing a second angle for the tool during a fine sharpening operation during which the first side of the tool contactingly engages the line contact portion of the second guide surface and is then moved away therefrom as the cutting edge is contactingly advanced along the second abrasive surface at said presentation angle, the second angle greater than the first angle.

14. The hand-held sharpener of claim 13, in which the elongated member is characterized as an abrasive rod having at least a selected one of a circular, triangular, rectilinear or curvilinear cross-sectional shape and the second abrasive surface extends along at least a portion of an outermost surface of the abrasive rod.

15. The hand-held sharpener of claim 13, in which the first sharpening stage comprises at least a selected one of a pull-through ripper, a rotatable abrasive disc rotated by a motor, or an abrasive block of material affixed to a side of the handle.

16. The hand-held sharpener of claim 13, in which the first sharpening guide establishes a first sharpening angle on the first side of the blade portion of the cutting tool and the second sharpening guide establishes a second sharpening angle on the first side of the blade portion of the cutting tool to micro-bevel the first side.

17. A hand-held knife-sharpener for sharpening a cutting tool having a blade portion with opposing first and second side surfaces, the hand-held sharpener comprising:

a handle with an outer grip surface adapted to be gripped by a first hand of a user, the handle oriented along a longitudinally extending axis with opposing first and second ends;

a first sharpening stage incorporated into the handle between the first and second ends and comprising a first abrasive surface and a first guide surface which cooperate to impart a first sharpening angle to a first beveled portion of the first side surface of the blade portion of the tool during a coarse sharpening operation during which a first cutting edge of the blade portion of the tool between the first and second side surfaces contactingly engages the first abrasive surface and a selected one of the first or second side surfaces contactingly engages the first guide surface; and a second sharpening stage coupled to the first end of the handle and comprising a second abrasive surface which extends in a direction parallel to the longitudinally extending axis and a second guide surface having a line contact portion extending along a nominally straight line toward the second abrasive surface at a selected non-orthogonal angle with respect to the second abrasive surface, the second abrasive surface and the second guide surface cooperating to impart a second sharpening angle to a second beveled portion of the first side surface of the blade portion of the tool between the first beveled portion and a second cutting edge established during a fine sharpening operation in which the second cutting edge contactingly engages the second abrasive surface and the first side surface contactingly engages the line contact portion of the second guide surface to orient the tool at said non-orthogonal angle, wherein the first sharpening angle is less than the second sharpening angle to impart a micro-bevel on the tool adjacent the second cutting edge.

18. The hand-held sharpener of claim 17, in which the second sharpening stage further comprises a third guide surface which extends toward the second abrasive surface at the selected non-orthogonal angle with respect to the second abrasive surface, the second abrasive surface disposed between the second and third guide surfaces.

19. The hand-held sharpener of claim 18, in which the second abrasive surface is characterized as an outer surface of an abrasive rod which extends from the first end of the handle.

20. The hand-held sharpener of claim 19, in which the second abrasive surface is supported on an elongated member slideable between a fully retracted position in which the elongated member is nestingly retracted into an interior chamber of the handle and a fully extended position in which the elongated member fully extends from the handle.

* * * * *